US006425406B1

(12) United States Patent
Klinkhammer et al.

(10) Patent No.: US 6,425,406 B1
(45) Date of Patent: Jul. 30, 2002

(54) TOILET BOWL CLEANING METHOD

(75) Inventors: Michael E. Klinkhammer, Racine; Timothy I. Moodycliffe, Milwaukee; Virginia M. Hempel, Racine, all of WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/395,618

(22) Filed: Sep. 14, 1999

(51) Int. Cl.[7] ..... B08B 9/00

(52) U.S. Cl. ..... 134/22.19; 134/198; 510/384; 510/191; 510/238; 510/423; 510/504; 510/505; 252/238; 252/546

(58) Field of Search ..... 134/198, 22.19; 510/384, 191, 238, 423, 504, 505; 252/238, 546

(56) References Cited

U.S. PATENT DOCUMENTS

| | | | | | |
|---|---|---|---|---|---|
| 4,501,680 | A | * | 2/1985 | Aszman et al. | 252/142 |
| 5,409,630 | A | * | 4/1995 | Lysy et al. | 252/174.23 |
| 5,536,452 | A | | 7/1996 | Black | 252/238 |
| 5,587,022 | A | | 12/1996 | Black | 134/26 |
| 5,837,664 | A | | 11/1998 | Black | 510/238 |
| 5,851,980 | A | | 12/1998 | Avery | 510/424 |
| 5,948,741 | A | * | 9/1999 | Ochomogo et al. | 510/191 |
| 6,136,770 | A | * | 10/2000 | Cheung et al. | 510/384 |

FOREIGN PATENT DOCUMENTS

| | | |
|---|---|---|
| CA | 2201406 | 10/1998 |
| EP | 0832964 A | 4/1998 |
| WO | WO 96/22346 | 7/1996 |
| WO | WO 97/06237 | 2/1997 |
| WO | WO 98/02511 | 1/1998 |
| WO | WO 98/57544 | 12/1998 |
| WO | WO 99/19432 | 4/1999 |
| WO | WO 99/66017 | 12/1999 |
| WO | WO 00/12662 | 3/2000 |

OTHER PUBLICATIONS

The formulation of Example 1 of the application is admitted prior art as applied to a tiolet bowl cleaner used with a brush. The formulation of Example 2 of the application is admitted prior art as applied to a tiolet bowl cleaner used with a brush.

* cited by examiner

*Primary Examiner*—Randy Gulakowski
*Assistant Examiner*—M. Kornakov

(57) ABSTRACT

Disclosed herein are methods of cleaning toilet basins and urinals. Cleaning components are applied to the interior surfaces of these basins other than through the flush water, without scrubbing. They are allowed to be in contact with the surface of the basin for at least one-half hour before normal use of the toilet/urinal. Preferred methods for applying the cleaning compositions are with a spray bottle or an aerosol can, with application occurring on a daily, overnight basis.

12 Claims, No Drawings

TOILET BOWL CLEANING METHOD

CROSS REFERENCE TO RELATED APPLICATIONS

Not applicable.

STATEMENT REGARDING FEDERALLY SPONSORED RESEARCH

Not applicable.

BACKGROUND OF INVENTION

The present invention relates to a method of cleaning plumbing fixtures. More particularly it relates to a method of cleaning toilet bowls and urinals which alleviates the need for scrubbing or manually wiping the basin to work in the cleaner.

A variety of toilet bowl cleaners are known which are intended to be used by scrubbing them against a toilet basin. In some cases the cleaners are liquids that are squirted from a bottle against the basin (e.g. "Liquid Toilet Duck" sold by S. C. Johnson & Son, Inc.). In other cases the cleaners are aerosol sprays that are sprayed against the side of the basin (e.g. "Vanish" toilet bowl cleaner sold by S. C. Johnson & Son, Inc.).

It is also known in the art to provide a product that is sprayed against a shower or bathtub wall immediately after the use of the shower or bathtub which keeps the tub or shower cleaner without the need for wiping. This is described in U.S. Pat. No. 5,587,022 (see also the related U.S. Pat. Nos. 5,536,452 and 5,587,664, and the related PCT publications WO 96/22346 and WO 98/02511).

However, toilet and urinal basins are designed to receive contaminated waste. Even after flushing)the basins often sit partially filled with hard water that contains minerals that can stain a bowl (e.g. leave a ring). Existing cleaning formulations that are designed to keep showers or bathtubs relatively clean without scrubbing are ineffective for toilet basins and urinals.

A variety of techniques have been developed for delivering cleaning compounds via the flush water that sits in a toilet bowl. However, delivering the cleaning solution to the water of the bowl in this way dilutes the cleaning material. Moreover, such systems are less effective for the portion of the bowl above the water line.

With respect to urinals, blocks of disinfecting materials have been positioned near the outlet of the basin, sometimes in or on top of ice. However, such materials are not designed to clean the side walls of the basin.

In that the prior art has not to date provided a satisfactory way of cleaning the side walls of a toilet or urinal basin which alleviates the need for scrubbing or wiping a cleaner against the basin, sponges, brushes and the like that have been contaminated with toilet bowl water and cleaner still need to be stored between uses.

Thus, a need exists for improved methods of cleaning toilet bowls and urinals.

SUMMARY OF THE INVENTION

In one aspect the invention provides a method of cleaning a basin of a plumbing fixture selected from the group consisting of toilet bowl and urinal basins. Such basins have a drain opening and a side wall portion extending upwardly therefrom. One applies a cleaning composition containing at least water and a surfactant to the side wall portion other than via flush water. One then, allows the cleaning composition to remain on the side wall portion for at least one half hour (preferably at least an hour, even more preferably at least six hours) after it is applied. The method is completed without the cleaning composition being scrubbed against or manually wiped against the wall, and without the composition being completely rinsed off the wall during the period.

The surfactant can be any of the known anionic, nonionic, cationic or zwitterionic surfactants that are suitable for use in a toilet bowl environment, albeit a mixture of either nonionic and anionic, or nonionic and cationic, surfactants is preferred for this purpose.

In a further aspect, the basin is a toilet bowl basin having a top portion, and the cleaning composition is applied at least between the top portion and a normal "water line" of the basin (the normal fill level of the basin).

The cleaning composition is preferably delivered via a spray so that the cleaning composition will in large part adhere to the bowl sides above the water (rather than primarily running down into the bowl water). A pump sprayer can be used to deliver the material, or the material can be combined with an aerosol gas propellant (such as propane, butane, isobutane, and mixtures thereof) and then delivered from an aerosol can.

These and still other features of the present invention will be apparent from the description which follows. The following description is of the preferred embodiments. a However, the claims should be looked to in order to better understand the full scope of the invention.

DETAILED DESCRIPTION

EXAMPLE 1

Nonionic Mixed with Cationic-pump Spray

One preferred liquid spray type cleaner has the following formula:

| ingredient | preferred source | weight % |
|---|---|---|
| water | | 97.522 |
| ethoxylated alcohol | Lutensol A08 | 1.00 |
| sodium lauryl ether sulfate | Steol 4N | 0.500 |
| sulphamic acid | | 0.500 |
| fragrance | | 0.250 |
| cellulosic thickener | Rheozan | 0.220 |
| dye | Pigmosol blue 6900 | 0.008 |

Example 1 was applied to a toilet bowl by spraying it from a pump trigger bottle in which it was contained. The product was sprayed in a manner to cover the entire inside wall of the bowl above the water line and below the rim. About 10 g of spray was required to achieve desired coverage. The applied product was allowed to remain in contact with the bowl for a minimum of one-half hour (preferably at least six hours—over night), after which the toilet could be used in the usual manner.

This procedure was repeated once a day for four weeks. This resulted in the removal of all visible stains and deposits, and prevented further stains from forming on the bowl sides above the water line.

EXAMPLE 2

Nonionic and Cationic-Aerosol

An aerosol form of the invention has the following formula:

| ingredient | preferred source | weight % |
|---|---|---|
| deionized water | | 76.692720 |
| tetrasodium salt EDTA | | 10.152000 |
| ethylenediamine tetraacetic acid | | 0.122200 |
| diethelene glycol butyl ether | | 5.64000 |
| nonylphenol ethoxylated alcohol Tergitol NP-10 | Union Carbide | 0.188000 |
| nonionic surfactant | Sandoxylate Sx-424 -Clariant Corporation | 0.188000 |
| fragrance | | 0.094000 |
| isobutane | | 6.000000 |
| miristalammonium chloride and quaternium 14-disinfectant/surfactant | Stepan | 0.406080 |

Example 2 was sprayed into a toilet bowl in essentially the same manner as described in Example 1 for the spray bottle, albeit from an aerosol can. It was applied at the same intervals and with similar results.

EXAMPLE 3

Pump Spray

The following formulation is also suitable for use with a trigger nozzle delivery system:

| ingredient | preferred source | weight % |
|---|---|---|
| water | | 92.787 |
| Ammonyx DO C10 amine oxide | Stepan | 1.67 |
| Glucopon 325 NK | Henkel | 1.5 |
| bacteriocide BTC 2125M, 80% | Stepan | 0.27500 |
| fragrance | | 0.150 |
| propylene glycol monobutylether | | 3.0 |
| tetrasodium salt of EDTA 40% | | 0.4 |
| caustic soda, 50% | | 0.218 |

Other Variations

While certain specific ingredients have been described as being useful for formulations of the present invention, these can be varied. For example, the anionic surfactant is preferably 0 to 10% of the formulation, the cationic surfactant is preferably 0 to 10% of the formulation, the nonionic surfactant is preferably 0.2 to 10% of the formulation, and there is preferably up to 5% sulphamic acid or up to 15% tetrasodium salt of EDTA, and up to 3% fragrance. There is also preferably more than 75% water. There can also be other additives and dyes as are conventional with toilet bowl cleaners.

While this invention has been described above in connection with cleaning a toilet bowl, it can also be effectively employed in conjunction with a urinal. The cleaner composition would be applied along the inner side walls of the urinal. As in conjunction with a toilet bowl, the cleaner could be applied on a daily basis and preferably at the end of the day. It should be allowed to remain in contact with the inner surface of the urinal for at least one half hour, and preferably six hours, before rinsing.

Industrial Applicability

The invention provides a method of cleaning urinals and toilets which receive flushable waste.

We claim:

1. A method of cleaning a basin of a plumbing fixture selected from the group consisting of toilet bowl basins and urinal basins, the basin having a drain opening and a side wall portion extending upwardly therefrom, the method comprising:

applying a cleaning composition containing water and (i) a cationic surfactant or (ii) an anionic surfactant to the side wall portion other than via flush water, there being one but not both of cationic surfactant and anionic surfactant in the composition; and allowing the cleaning composition to remain on the wall portion for at least one half hour after it is applied on the wall portion;

wherein the method is completed without the cleaning composition being scrubbed against or manually wiped against the wall.

2. The method of claim 1, wherein as part of the method the cleaning composition is allowed to contact the side wall portion for at least one hour after application of the cleaning composition against the wall.

3. The method of claim 1, wherein as part of the method the cleaning composition is allowed to contact the side wall portion for at least six hours after application of the cleaning composition against the wall.

4. The method of claim 1, wherein the plumbing fixture is a toilet bowl having a top portion and the cleaning composition is applied along the side wall at least between the top portion and a normal water level line of the toilet bowl.

5. The method of claim 1, wherein the cleaning composition further comprises an aerosol propellant gas.

6. The method of claim 1, wherein the cleaning composition comprises both a nonionic and an anionic surfactant.

7. The method of claim 1, wherein the cleaning composition comprises both a nonionic and a cationic surfactant.

8. The method of claim 1, wherein the cleaning composition comprises a disinfectant.

9. A method of cleaning a basin of a plumbing fixture selected from the group consisting of toilet bowl basins and urinal basins, the basin having a drain opening and a side wall portion extending upwardly therefrom, the method comprising:

applying a cleaning composition containing water and a surfactant to the side wall portion other than via flush water; and allowing the cleaning composition to remain on the wall portion for at least one half hour after it is applied on the wall portion, wherein the method is completed without the cleaning composition being scrubbed against or manually wiped against the wall, and wherein the cleaning composition comprises anionic surfactant present in a range of 0% to 10% by weight or cationic surfactant present in a range of 0% to 10% by weight, there being one but not both of cationic surfactant and anionic surfactant in the composition, nonionic surfactant being present in a range of 0.2% to 10% by weight, sulphamic acid being present in a range of 0% to 5% by weight or sodium salt of EDTA being present in a range of 0% to 15% by weight, and fragrance being present in a range of 0% to 3% by weight.

10. A method of cleaning a basin of a plumbing fixture selected from the group consisting of toilet bowl basins and urinal basins, the basin having a drain opening and a side wall portion extending upwardly therefrom, the method comprising:

applying a cleaning composition to the side wall portion other than via flush water, wherein the cleaning composition comprises water, anionic surfactant present in a range of 0.00% to 10.00% by weight or cationic surfactant present in a range of 0.00% to 10.00% by weight, there being one but not both of cationic surfactant and anionic surfactant in the composition, nonionic surfactant being present in a range of 0.20% to 10.00% by weight, sulphamic acid being present in a range of 0.00% to 5.00% by weight or sodium salt of EDTA being present in a range of 0.00% to 15% by weight, and fragrance being present in a range of 0.00% to 3.00% by weight; and allowing the cleaning composition to remain on the side wall portion for at least one half hour after it is applied on the side wall portion, wherein the cleaning composition is applied to the side wall portion via a pump spray or an aerosol spray, and wherein the method is completed without the cleaning composition being scrubbed against or manually wiped against the side wall portion.

11. The method of claim 10, wherein:

the cleaning composition is allowed to remain on the wall portion for at least one hour after it is applied on the side wall portion.

12. The method of claim 10, wherein:

the cleaning composition is allowed to remain on the wall portion for at least six hours after it is applied on the side wall portion.

* * * * *